US005104579A

United States Patent [19]

Benjamin et al.

[11] Patent Number: 5,104,579

[45] Date of Patent: Apr. 14, 1992

[54] PHOSPHONATE ADDUCTS OF OLEFINIC LUBRICANTS HAVING ENHANCED PROPERTIES

[75] Inventors: Linda A. Benjamin, Horsham; Derek A. Law, Yardley, both of Pa.; Andrew G. Horodysky, Cherry Hill, N.J.

[73] Assignee: Mobil Oil Corporation, Fairfax, Va.

[21] Appl. No.: 211,482

[22] Filed: Jun. 24, 1988

[51] Int. Cl.[5] ..... C10M 1/46; C10M 105/74

[52] U.S. Cl. ..... 252/46.6; 252/32.5; 252/49.8; 252/49.9; 525/340; 558/81; 558/85; 558/119; 558/166; 558/179; 558/183; 558/190; 558/198; 558/214

[58] Field of Search ..... 252/32.5, 32, 49.8, 252/61, 78.5, 49.9, 46.6; 44/76; 585/18, 529; 525/333.7, 340; 558/81, 85, 119, 166, 179, 183, 190, 198, 214

[56] References Cited

U.S. PATENT DOCUMENTS

| | | | |
|---|---|---|---|
| 2,957,931 | 10/1960 | Hamilton et al. | 260/403 |
| 3,637,503 | 1/1972 | Gianetti | 252/59 |
| 3,795,616 | 3/1974 | Heilman et al. | 252/59 |
| 3,965,018 | 6/1976 | Heilman et al. | 252/59 |
| 4,018,695 | 4/1977 | Heilman et al. | 252/23 |
| 4,247,421 | 1/1981 | McDaniel et al. | 252/458 |
| 4,282,392 | 8/1981 | Cupples et al. | 585/10 |
| 4,362,654 | 12/1982 | Vance | 252/469 |
| 4,434,308 | 2/1984 | Larkin et al. | 585/10 |
| 4,434,309 | 2/1984 | Larkin et al. | 585/10 |
| 4,510,342 | 4/1985 | Currie et al. | 585/524 |
| 4,587,368 | 5/1986 | Pratt | 585/12 |
| 4,613,712 | 9/1986 | Bridger | 585/10 |

OTHER PUBLICATIONS

Journal of Catalysis 88, 424–430 (1984) Weiss & Krauss.

*Primary Examiner*—Margaret B. Medley
*Attorney, Agent, or Firm*—Alexander J. McKillop; Charles J. Speciale; Malcolm D. Keen

[57] ABSTRACT

It has now been discovered that oligomers of $C_6$- $C_{20}$ alpha-olefins, such as 1-decene, with branch ratios below 0.19 and high viscosity indices (HVI) can be functionalized to provide unique phosphite derivatives. Functionalized polyalpha-olefin lubricants compositions are prepared with superior properties by adding functionalized organophosphites to the olefinic bond of HVI-PAO. The invention encompasses a process for the preparation of lubricant range hydrocarbons containing phosphonate functional groups, comprising;

reacting olefinic $C_{20}$+ polyalpha-olefin oligomers having a branch ratio of less than 0.19 and phosphite ester in a mixture with peroxide catalyst at elevated temperature whereby phosphite ester adduct of said polyalpha-olefin is formed;

separating said reaction mixture products and recovering said adduct.

16 Claims, No Drawings

PHOSPHONATE ADDUCTS OF OLEFINIC LUBRICANTS HAVING ENHANCED PROPERTIES

This invention relates to novel polyalpha-olefin lubricants containing phosphonate functional groups which confer improved lubricant properties thereon. In particular, the invention relates to novel phosphonate adducts of lubricants wherein typical properties of lubricant additive chemicals, such as extreme pressure antiwear, antirust, antioxidant properties, are incorporated into the lubricant molecular structure by phosphite functionalization.

This invention also relates to novel lubricant compositions exhibiting superior lubricant properties such as high viscosity indices. More particularly, this discovery provides novel lubricant basestocks, additives and blends of phosphite functionalized high viscosity index polyalpha-olefin, herein sometimes called "P/HVI-PAO", with conventional lubricants, such as acid-catalyzed $C_{30}$+ liquid polyolefin synthetic lubes and/or mineral oil lubricant basestock.

The formulation of lubricants typically includes an additive package incorporating a variety of chemicals to improve or protect lubricant properties in application specific situations, particularly internal combustion engine and machinery applications. The more commonly used additives include oxidation inhibitors, rust inhibitors, metal passivators, antiwear agents, extreme pressure additives, pour point depressants, detergent-dispersants, viscosity index (VI) improvers, foam inhibitors and the like. This aspect of the lubricant arts is specifically described in Kirk-Othmer "Encyclopedia of Chemical Technology", 3rd edition, Vol. 14, pp477–526, incorporated herein by reference. Considering the diversity of chemical structures represented by the plethora of additives incorporated in a typical lubricant formulation, and the quantity in which they are added, the artisan in the lubricant formulation arts faces a substantial challenge to provide a homogeneous formulation which will remain stable or in solution during inventory and during use. Lubricants, particularly synthetic lubricants of the type of interest in the instant invention, are usually hydrogenated olefins containing, optionally, mineral oil, ester lubricants and the like.. Due to their hydrocarbon structure they are largely incompatible with polar additives such as antioxidants, antirust and antiwear agents, etc. Accordingly, in order to render the lubricants compatible with the polar additives large amounts of expensive polar organic esters must be added to the formulation. Useful commercial formulations may contain 20% percent or more of such esters as bis-tridecanol adipate or pentaerythritol hexanoate for example, primarily to provide a fully homogeneous lubricant blend of lubricant and additive.

Modifying the solvent properties of lubricants with solubilizing agents such as organic esters, while solving the problem of how to prepare stable blends with lubricant additives, creates or accentuates other performance related problems beyond the added burden on cost of the product. Accordingly, workers in the field are challenged by the need to incorporate the desirable properties of additives into lubricants, without incurring the usual physical and cost liabilities.

One class of lubricants of particular interest in the present invention are synthetic lubricants obtained by the oligomerization of olefins, particularly $C_6$–$C_{20}$ alpha olefins. Catalytic oligomerization of olefins has been studied extensively. Many catalysts useful in this area have been described, especially coordination catalyst and Lewis acid catalysts. Known olefin oligomerization catalysts include the Ziegler-Natta type catalysts and promoted catalysts such as BF3 or AlCl3 catalysts. U.S. Pat. No. 4,613,712 for example, teaches the preparation of isotactic alpha-olefins in the presence of a Ziegler type catalyst. Other coordination catalysts, especially chromium on a silica support, are described by Weiss et al in Jour. Catalysis 88, 424–430 (1984) and in Offen. DE 3,427,319.

Poly alpha-olefin oligomers as reported in literature or used in existing lube base stocks are usually produced by Lewis acid catalysis in which double bond isomerization of the starting alpha-olefin occurs easily. As a result, the olefin oligomers have more short side branches and internal olefin bonds. These side branches degrade their lubricating properties. Recently, a class of synthetic, oligomeric polyalpha-olefin lubricants, referred to herein as HVI-PAO, has been discovered, as reported in U.S. patent application Ser. No. 946,226 filed Dec. 24, 1986, with a regular head-to-tail structure and containing a terminal, or vinylidenic, olefinic bond. These lubricants have shown remarkably high viscosity index (VI) with low pour points and are especially characterized by having a low branch ratio, as defined hereinafter.

Accordingly, it is an object of the present invention to incorporate into HVI-PAO lubricant those properties typically associated with lubricant additives.

It is another object of the instant invention to improve HVI-PAO properties by incorporating additive functional properties into HVI-PAO by forming adducts with organophosphites.

Yet another object of the instant invention is to improve lubricant properties of mineral oil based and synthetic lubricants by blending with HVI-PAO containing functionalized phosphonate groups.

SUMMARY OF THE INVENTION

It has been discovered that functionalized HVI-PAO lubricants can be prepared with superior properties by adding functionalized organophosphites, also referred to as phosphite esters herein, to the olefinic bond of HVI-PAO according to the general peroxide catalyzed reactions:

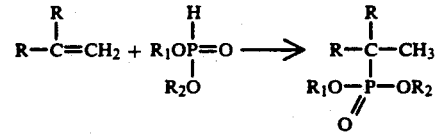

and

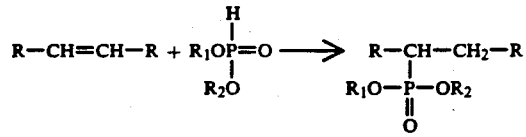

where R is the alkyl HVI-PAO moiety of $C_{18}$+ carbon atoms, $R_1$ and/or $R_2$ are carbon radicals of aliphatic or aromatic moieties, either substituted or unsubstituted, which may be linear, cyclic or heterocyclic, and derivatives thereof.

The terms functionalized or functionalization when applied to the organophosphites or products of the present invention mean the incorporation into the molecular structure of the organophosphite and/or HVI-PAO a radical or molecular group containing a structure which is known, or discovered, to confer desirable additive properties on the lubricant. Typically but not exclusively, the functionalizing radical or molecular group mimics or is analogous in structure to the structure of known additives.

The presently disclosed alpha-olefin oligomer derivatives are superior as lubricating fluid media with internal synergistic antiwear, antioxidant properties and useful as extreme pressure/antiwear additives for both mineral and synthetic lubricating oil. It has now been discovered that oligomers of $C_6$- $C_{20}$ alpha-olefins (HVI-PAO), such as 1-decene, with branch ratios below 0.19, high viscosity indices (HVI) and pour points below −15° C. e.g. olefinic $C_{20}$+ polyalpha-olefin oligomer, can be funtionalized to provide unique phosphite derivatives. Products obtained from reaction of chromium catalyzed polyalpha-olefin and various functionalized phosphites are unique not only in composition and stucture but in utility. These products have demonstrated excellent high and low temperature lubricating properties with exceptional extreme pressure and/or antiwear properties with potential friction reducing and corrosion inhibiting properties.

These oligomers with low branch ratios can be used as basestocks and/or additives for many lubricants or greases with an improved viscosity-temperature relationship, oxidative stability, volatility, etc. They can also be used to improve viscosities and viscosity indices of lower quality mineral oils.

The olefinic oligomer precursors can, for example, be oligomerized over a catalyst comprising reduced metal oxide from Group VIB of the Periodic Table supported on a porous substrate, such silica, to give oligomers suitable for lubricant application. More particularly, the instant application is directed to a process for the oligomerization of olefinic hydrocarbons containing from 6 to about 20 carbon atoms which comprises oligomerizing said hydrocarbon under oligomerization conditions, wherein the reaction product is composed of substantially non-isomerized olefins, for example, oligomers of alpha-olefins such as 1-decene, and wherein a major proportion of the double bonds of the olefins or olefininc hydrocarbons are not isomerized, in the presence of a suitable catalyst from Group VIB of the Periodic Table. It is therefore an object of this invention to produce functionalized oligomers having a low branch ratio, low pour point, and superior lubricating properties.

DESCRIPTION OF PREFERRED EMBODIMENTS

Synthetic polyalpha-olefins (PAO) have found wide acceptability and commercial success in the lubricant field for their superiority to mineral oil based lubricants. In terms of lubricant properties improvement, industrial research effort on synthetic lubricants has led to PAO fluids exhibiting useful viscosities over a wide range of temperature, i.e., improved viscosity index (VI), while also showing lubricity, thermal and oxidative stability and pour point equal to or better than mineral oil. These relatively new synthetic lubricants lower mechanical friction, enhancing mechanical efficiency over the full spectrum of mechanical loads from worm gears to traction drives and do so over a wider range of ambient operating condition than mineral oil. The PAO'S are prepared by the polymerization of 1-alkenes using typically Lewis acid or Ziegler-type catalysts. Their preparation and properties are described by J. Brennan in Ind. Eng. Chem. Prod. Res. Dev. 1980, 19, pp 2–6, incorporated herein by reference in its entirety. PAO incorporating improved lubricant properties are also described by J. A. Brennan in U.S. Pat. Nos. 3,382,291, 3,742,082, and 3,769,363, also incorporated herein in their entirety by reference.

In accordance with customary practice in the lubricating art, PAO'S have been blended with a variety of functional chemicals, oligomeric and high polymers and other synthetic and mineral oil based lubricants to confer or improve upon lubricant properties necessary for applications such as engine lubricants, hydraulic fluids, gear lubricants, etc.

Recently, a novel class of PAO lubricant compositions, herein referred to as HVI-PAO, exhibiting surprisingly high viscosity indices has been reported by M. Wu in U.S. patent application Ser. No. 946,226, filed Dec. 24, 1986 now abandoned. These novel PAO lubricants can by synthesized by 1-decene oligomerization with a reduced valence state supported chromium catalyst, and may be characterized by low ratio of methyl to methylene groups, i.e., low branch ratios, as further described hereinafter. Their very unique structure provides new opportunities for the formulation of distinctly superior and novel lubricants. Reaction products of chromium catalyzed polyalpha-olefin, e.g. 1-decene oligomers, with various functionalized phosphites exhibit excellent lubricating properties in conjunction with good extreme pressure/antiwear, antioxidant and friction reducing properties.

Compositions according to the present invention may be formulated according to known lube blending techniques to combine P/HVI-PAO components with various phenylates, sulphonates, succinamides, esters, polymeric VI improvers, ashless dispersants, ashless and metallic detergents, extreme pressure and antiwear additives, antioxidants, corrosion inhibitors, defoamants, biocides, friction reducers, anti-stain compounds, etc.

Lubricants having enhanced viscosity indices have been discovered comprising P/HVI-PAO having a branch ratio of less than 0.19, especially in combination with liquid lubricant taken from the group consisting essentially of mineral oil, hydrogenated PAO, vinyl polymers, polyethers, polyesters, polycarbonates, silicone oils, polyurethanes, polyacetals, polyamides, polythiols; their co-polymers, terepolymers, and mixtures thereof. Unexpectedly, when a low viscosity lubricant is blended with a high viscosity, high VI lubricant produced from alpha-olefins containing $C_6$ to C20 atoms, the resulting blends have high viscosity indices and low pour points. The high viscosity index lubricant produced as a result of blending P/HVI-PAO and PAO has much lower molecular weight than a conventional polymeric VI improver, thus offering the opportunity of greater shear stability.

Incorporation of phosphite derivatives such as phosphite esters onto the backbone of lower valence state Group VIB metal oligomerized olefin provides the basis for the unique properties of extreme pressure/antiwear activity, thermal stability and lubricity. Functionalized phosphite-adducts will contribute additional friction reducing, rust inhibiting and hydrolytic stabilizing benefits. All of the above-mentioned properties are believed to be enhanced as a result of this novel multidimensional internal synergism.

The use of these functionalized compositions, as detailed in the present disclosure, as lubrication fluids and additives in either a mineral or synthetic lubricant is unique and provides unprecedented performance benefit due to the inherent internal synergism. The process of enhancement of lubricating properties by addition of these compositions to either mineral or synthetic lubricants is surprising. For example, the process of improving wear, friction, corrosion inhibition and thermal stability of a high temperature, high viscosity olefin oligomer via the addition of 0.1–100% of an adduct of a diol-derived phosphite and chromium-catalyzed polyalpha-olefin is unique and not manifested in prior art. Additionally, the combination of lubricant formulations containing the above compositions with any of the following supplemental additives: dispersants, detergents, viscosity index improvers, extreme pressure/antiwear additives, antioxidants, pour depressants, emulsifiers, demulsifiers, corrosion inhibitors, antirust inhibitors, antistaining additives, friction modifiers, and the like are novel. Additionally, any post-reactions of these unique functionalized phosphite olefins with small amounts of functionalized olefins such as vinyl esters, vinyl ethers, acrylates and methacrylates are also believed to be novel.

Incorporation of functionalized phosphites onto the backbone of the chromium-catalyzed polyalpha-olefin offers unique advantages over conventionally formulated lubricants where volatility or extraction is considered to be important. The chromium-catalyzed olefin oligomers are themselves unique in that they have a higher VI, between 130 and 280, at a given viscosity and low pour point less than −15° C. They have enhanced reactivity over traditional high VI olefins due to the fact that they contain a terminal or vinylidenic olefinic group. In addition, the chromium-catalyzed olefin oligomers have improved thermal stability over comparable polybutylene olefins. Therefore, the adduct products from the addition of novel functionalized phosphites and chromium-catalyzed olefin oligomers HVI-PAO are unique and not evident in prior art. Selected multifunctional phosphorus-containing moieties useful in forming the adducts of the present invention to confer additive properties on HVI-PAO are shown in Table I, structures I-XI.

Chromium-catalyzed polyalpha-olefin derived adducts of aliphatic vicinal diol derived phosphites (I) can possess the expected antiwear properties associated with the use of the phosphite as an additive and also synergistically exhibit friction reduction, enhanced hydrolytic stability and additive solubilizing features from the vicinal diol group. Analogous sulfide-containing vicinal diol derived phosphite (II) lube olefin adducts can provide better antioxidant and antiwear properties. These effects are expected to be synergistic due to both sulfur and phosphorus incorporation. Similarly, ether alcohol derived phosphites (III) adducts of HVI-PAO olefins can provide improved chelating ability and solubility/detergency with the ether linkage. Amino alcohol derived phosphite (IV) adducts can improve rust inhibition and emulsibility/demulsibility properties. Hydroxyester derived phosphite (V) adducts improve frictional properties, rust inhibiting characteristics and additive solubility in the HVI-PAO base fluid. Some heterocyclic substituted alcohol derivatives, such as imidazolines (VI) and oxazoline (VII), can exhibit antirust, friction reducing and dispersant type properties. Alkoxylated amine phosphite (VIII) adducts improve friction reducing and antiwear performance in addition to rust inhibition. Phosphorodithioate (IX) derived adducts are multidimensional in that the phosphorous/sulfur moiety can provide antioxidant/antiwear properties, the ether linkage can provides solubility characteristics while the phosphite end can provide enhanced EP/antiwear properties. Aromatic derived phosphites, e.g. catechol (X), resorcinol, phenolic or substituted catechol, resorcinol, phenolic, all contain an intrinsic synergistically placed antioxidant group which can be released under hydrolytic conditions or otherwise in service conditions. In addition, these multifaceted phosphite adducts can exhibit antiwear properties and friction modifying properties.

All of the above mentioned chromium-catalyzed polyalphaolefin-phosphite adducts exhibit beneficial properties from the unique olefin in combination with those properties unique to a given functionalized phosphite, and this combination provides for a novel structural class and a unique multifaceted synergistic set of properties. The use of these compositions of matter to improve the above lubricant features either as a functional fluid or partial fluid replacement or as additives for lubricants is believed to be novel.

In Table I, some phosphite compositions such as phosphite esters useful in the present invention are illustrated. In Table I R is a carbon radical of an aliphatic or aromatic moiety, substituted or unsubstituted, linear, cyclic or heterocyclic. The substituted moiety may contain oxygen, nitrogen, sulfur of halogen. For example, R may be $C_1$–$C_{20}$ alkyl or alkenyl, 2-hydroxy propyl, 2-amino propyl,2-carboxy propyl, 2-mercapto propyl, 2-keto butyl, phenyl, benzyl, 4-amino phenyl, 2-ethoxy phenyl, 2-ethoxy ethyl, biphenyl, piperidinyl, thiophenyl and the like. $R_1$ is selected from $C_1$–$C_{20}$ aliphatic or aromatic hydrocarbon diyl such as $—CH_2—$, $—CH_2CH_2—$, $—CH_2(CH_2)_4CH_2—$, $—C_6H_4—$ and the like. $R_2$ is hydrogen, alkyl, alkenyl, aryl or aralkyl. $R_3$ is hydrogen or $C_1$–$C_8$ alkyl or aklenyl. Also in Table I, x in IX may be 0–10.

The R radical can be selected for incorporation into the phosphite depending upon the additive feature needed to be incorporated into the lubricant molecule, such as antirust, antioxidant, etc. Reaction of the phosphite so substituted with the olefinic lubricant according to the process described herein provides the novel modified or functionalized lubricant of the invention.

TABLE I

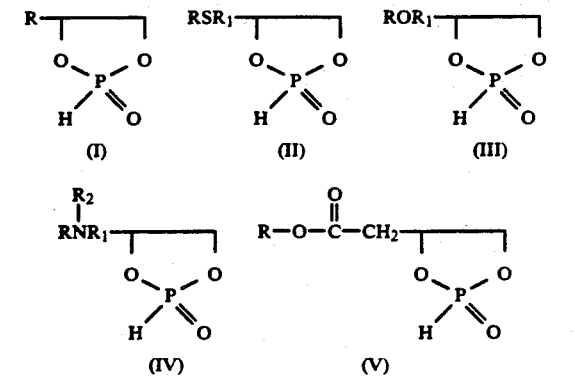

TABLE I-continued

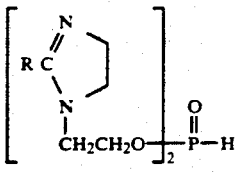

(VI)

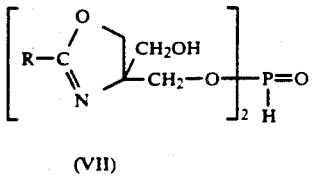

(VII)

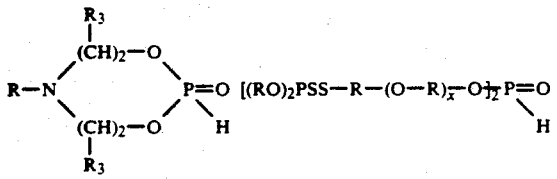

(VIII) (IX)

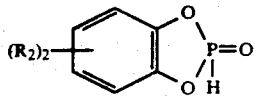

(X)

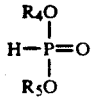

(XI)

More conventional type phosphites or phosphite esters can also provide a final product adduct with improved antiwear, and/or friction reducing properties. For example, reaction products between chromium on silica catalyzed polyalpha-olefin, e.g. 1-decene oligomers, or oligomers prepared by polymerizing 1-decene with Ziegler catalyst and a hydrogen phosphite of the following formula yield lube adducts with improved properties:

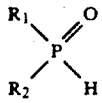

where $R_1$ and $R_2$ are independently alkyl of 1 to 18 carbon atoms, cycloalkyl of 2 to 12 carbon atoms, phenyl, phenyl substituted by alkyl of 1 to 18 carbon atoms, aralkyl of 7 to 9 carbon atoms or said aralkyl substituted by alkyl of 1 to 18 carbon atoms. $R_1$ and $R_2$ may also be derived from alcohols other than hydrocarbons such as ether alcohols, amino alcohols, sulfur-containing alcohols and diol type alcohols. The hydrogen phosphite may additionally be of the following formula:

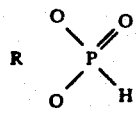

where R is an alkyl or alkenyl group of 2 to 12 carbon atoms, phenyl, phenyl substituted by alkyl of 1 to 18 carbon atoms, aralkyl and substituted aralkyl derivatives and, optionally, additives containing sulfur, nitrogen and oxygen. The phosphite can also be chosen from one or more of the multifunctional derivatives illustrated above.

The peroxide catalyzed reaction of dialkyl hydrogen phosphites with conventional olefins to give phosphonate derivatives is known as disclosed in U.S. Pat. No. 2,957,931 to Hamilton, incorporated herein by reference In the instant invention the reaction between unsaturated alpha-olefin oligomers (HVI-PAO) and phosphite compounds of the type described above proceeds, in general, as follows in the presence of peroxide catalyst:

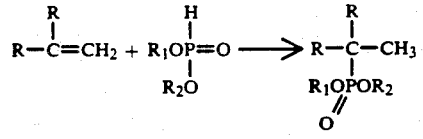

and

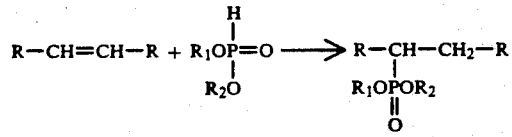

where R is the alkyl HVI-PAO moiety of $C_{30}$+ carbon atoms in total, $R_1$ and/or $R_2$ are carbon radicals of aliphatic or aromatic moieties, either substituted or unsubstituted, which may be linear, cyclic or heterocyclic, and derivatives thereof.

The peroxide catalyst used in the above reaction may be an organoperoxide or organohydroperoxide. A useful catalyst is tertiary butyl peroxide.

The free radical catalyzed addition of organophosphite to the olefinic bond of HVI-PAO can produce an isomeric mixture when the alkyl HVI-PAO moiety substituent groups on the olefinic carbons are different in 1,2-dialkyl HVI-PAO olefin or as in the following example:

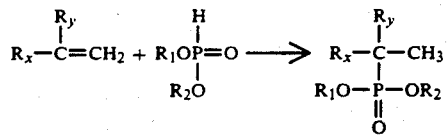

(I)

and

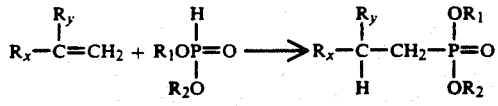

(II)

where an isomeric mixture is produced when $R_x$ and $R_y$ HVI-PAO moiety are alike or different. The ratio of (I) to (II) may be between 999:1 and 1:999.

The following examples illustrate the preparation of the novel functionalized lubricants of the present invention and their properties:

EXAMPLE 1

To 30 g (0.03 mole) of a 20 cs(centistoke) HVI-PAO lube olefin prepared in accordance with the procedure described hereinafter at 160 degrees C. under a nitrogen sparge is added dropwise over a 0.5 hr period 2.91 g (0.015 mole) dibutyl hydrogen phosphite and 0.3 wt % di-tertiary butyl peroxide. The reaction mixture is stirred for 2 hrs at 160 degrees C. The reaction mixture is distilled under vacuum to remove tert-butanol and unreacted phosphite. The resulting product is filtered through diatomaceous clay to yield a light yellow oil (18.98g). The product has the following elemental analysis:

%P=1.17

EXAMPLE 2

The procedure of Example 1 is repeated using 30.0 g (0.03 mole) of a 20cs HVI-PAO lube olefin, 0.58 g (0.003 mole) dibutyl hydrogen phosphite and o.03 wt % di tert butyl peroxide. The product was a clear yellow oil (22.08 g) and had the following elemental analysis:

%P=0.20

EXAMPLE 3

The procedure of Example 1 is repeated using 30 g (0.0094 mole) of a 145 cs HVI-PAO lube olefin prepared in accordance with the procedure described hereinafter, 0.91 g (0.0046 mole) of dibutyl hydrogen phosphite and 0.03 wt % of di-tert butyl peroxide. The product is a clear colorless oil (16.4 g) and has the following elemental analysis:

%P=0.33

EXAMPLE 4

The procedure of Example 1 is repeated using 30 g (0.0094 mole) of a 145 cs HVI-PAO lube olefin, 0.18 g (0.00094 mole) of dibutyl hydrogen phosphite and a 0.03 wt % of di-tert butyl peroxide. The product is a clear colorless oil (27.46 g) and has the following elemental analysis:

%P=0.03

EXAMPLES 5-7

The procedure of Example 1 is repeated using 30 grams of HVI-PAO of 20 cs, 0.03 wt % of di-tertiary butyl peroxide and 0.003 mole of 1,2-dihydroxy octadecene phosphonic acid derivative (Example 5), 0.003 mole of phosphonic acid derivative of hexadecene 1,2-dihydroxy ethane sulfide (Example 6), and 0.003 mole of the phosphonic acid derivative of propylene tetramer substituted resorcinol ( Example 7).

In the following Tables, the results of the evaluation of the products of the above examples as functionalized fluids are presented. The results are compared to an all synthetic brand of automotive engine oil as well as the unfunctionalized lube olefin. These data were obtained on the Four-ball Wear Apparatus (2000rpm, 200 degrees F., 60 kg).

TABLE II

| Specimen | Diameter Wear Scar (mm) | Wear Scar Volume ($\times 10^3$ mm$^3$) |
|---|---|---|
| Test Oil | 2.2 | |
| 20 cs Lube Olefin | 4.7 | 8082.0 |
| Example 1 | 1.3 | 48.7 |
| Example 2 | 0.4 | 0.5 |
| 145 cs Lube Olefin | 0.7 | 3.2 |
| Example 3 | 0.8 | 7.8 |
| Example 4 | 0.6 | 1.5 |

The products of the above examples were also evaluated at 2 wt % concentration in ASTD test mineral oil as lubricant additives. The results are compared to the test oil without additive. These data were obtained on the Four-Ball Wear Apparatus (2000rpm, 200 degrees F., 60 kg)

TABLE III

| Specimen | Additive Conc. wt % | Diameter Wear Scar (mm) | Wear Scar Volume ($v \times 10^3$ mm$^3$) |
|---|---|---|---|
| Test Oil | 0 | 2.4 | 550.6 |

TABLE III-continued

| Specimen | Additive Conc. wt % | Diameter Wear Scar (mm) | Wear Scar Volume ($v \times 10^3$ mm$^3$) |
|---|---|---|---|
| 20 cS Lube Olefin | 2 | 3.4 | 2,173.4 |
| Example 1 | 2 | 0.5 | 0.6 |
| Example 2 | 2 | 3.8 | 3346.8 |

The novel polyalpha-olefin lubricants HVI-PAO employed in the present invention to prepare the phosphonate adducts and thereby incorporate desirable additive properties into the oligomer structure are described in the following section with respect to their preparation and properties.

Olefins suitable for use as starting material in the invention include those olefins containing from 2 to about 20 carbon atoms such as ethylene, propylene, 1-butene, 1-pentene, 1-hexene, 1-octene, 1-decene, 1-dodecene and 1-tetradecene and branched chain isomers such as 4-methyl-1-pentene. Also suitable for use are olefin-containing refinery feedstocks or effluents. However, the olefins used in this invention are preferably alpha olefinic as for example 1-heptene to 1-hexadecene and more preferably 1-octene to 1-tetradecene, or mixtures of such olefins.

Oligomers of alpha-olefins in accordance with the invention have a low branch ratio of less than 0.19 and typically have a molecular weight between 400 and 14,000 with a number average molecular weight between 300 and 18,000. They have superior lubricating properties compared to the alpha-olefin oligomers with a high branch ratio, as produced in all known commercial methods.

This new class of alpha-olefin oligomers are prepared by oligomerization reactions in which a major proportion of the double bonds of the alphaolefins are not isomerized. These reactions include alpha-olefin oligomerization by supported metal oxide catalysts, such as Cr compounds on silica or other supported IUPAC Periodic Table Group VIB compounds. The catalyst most preferred is a lower valence Group VIB metal oxide on an inert support. Preferred supports include silica, alumina, titania, silica alumina, magnesia and the like. The support material binds the metal oxide catalyst. Those porous substrates having a pore opening of at least 40 angstroms are preferred.

The support material usually has high surface area and large pore volumes with average pore size of 40 to about 350 angstroms. The high surface area are beneficial for supporting large amount of highly dispersive, active chromium metal centers and to give maximum efficiency of metal usage, resulting in very high activity catalyst. The support should have large average pore openings of at least 40 angstroms, with an average pore opening of >60 to 300 angstroms preferred. This large pore opening will not impose any diffusional restriction of the reactant and product to and away from the active catalytic metal centers, thus further optimizing the catalyst productivity. Also, for this catalyst to be used in fixed bed or slurry reactor and to be recycled and regenerated many times, a silica support with good physical strength is preferred to prevent catalyst particle attrition or disintegration during handling or reaction.

The supported metal oxide catalysts are preferably prepared by impregnating metal salts in water or organic solvents onto the support. Any suitable organic solvent known to the art may be used, for example, ethanol, methanol, or acetic acid. The solid catalyst precursor is then dried and calcined at 200° to 900° C. by air or other oxygen-containing gas. Thereafter the catalyst is reduced by any of several various and well known reducing agents such as, for example, CO, $H_2$, $NH_3$, $H_2S$, $CS_2$, $CH_3SCH_3$, $CH_3SSCH_3$, metal alkyl containing compounds such as $R_3Al$, $R_3B$,$R_2Mg$, RLi, $R_2Zn$, where R is alkyl, alkoxy, aryl and the like. Preferred are CO or $H_2$ or metal alkyl containing compounds.

Alternatively, the Group VIB metal may be applied to the substrate in reduced form, such as CrII compounds. The resultant catalyst is very active for oligomerizing olefins at a temperature range from below room temperature to about 500° C. at a pressure of 0.1 atmosphere to 5000 psi. Contact time of both the olefin and the catalyst can vary from one second to 24 hours. The catalyst can be used in a batch type reactor or in a fixed bed, continuous-flow reactor.

In general the support material may be added to a solution of the metal compounds, e.g., acetates or nitrates, etc., and the mixture is then mixed and dried at room temperature. The dry solid gel is purged at successively higher temperatures to about 600° for a period of about 16 to 20 hours. Thereafter the catalyst is cooled down under an inert atmosphere to a temperature of about 250° to 450° C. and a stream of pure reducing agent is contacted therewith for a period when enough CO has passed through to reduce the catalyst as indicated by a distinct color change from bright orange to pale blue. Typically, the catalyst is treated with an amount of CO equivalent to a two-fold stoichiometric excess to reduce the catalyst to a lower valence CrII state. Finally the catalyst is cooled down to room temperature and is ready for use.

The product oligomers have a very wide range of viscosities with high viscosity indices suitable for high performance lubrication use. The product oligomers also have atactic molecular structure of mostly uniform head-to-tail connections with some head-to-head type connections in the structure. These low branch ratio oligomers have high viscosity indices at least about 15 to 20 units and typically 30–40 units higher than equivalent viscosity prior art oligomers, which regularly have higher branch ratios and correspondingly lower viscosity indices. These low branch oligomers maintain better or comparable pour points.

The branch ratios defined as the ratios of $CH_3$ groups to $CH_2$ groups in the lube oil are calculated from the weight fractions of methyl groups obtained by infrared methods, published in *Analytical Chemistry*, Vol. 25, No. 10, p. 1466 (1953).

$$\text{Branch ratio} = \frac{\text{wt fraction of methyl group}}{1 - (\text{wt fraction of methyl group})}$$

The following examples are presented for illustration purposes on the preparation of HVI-PAO. In the instant invention, the unsaturated HVI-PAO oligomer is used to form the adduct described. Hydrogenation of the HVI-PAO oligomer is not conducted where described in the following examples when the desired product is unsaturated oligomer for further reaction with phosphite ester.

EXAMPLE 8

Catalyst Preparation and Activation Procedure 1.9 grams of chromium (II) acetate ($Cr_2(OCOCH_3)_4 2H_2O$)(5.58 mmole) (commercially obtained is dissolved in 50 cc of hot acetic acid. Then 50 grams of a silica gel of 8–12 mesh size, a surface area of 300 $m^2/g$, and a pore volume of 1 cc/g, also is added. Most of the solution is absorbed by the silica gel. The final mixture is mixed for half an hour on a rotavap at room temperature and dried in an open-dish at room temperature. First, the dry solid (20 g) is purged with $N_2$ at 250° C. in a tube furnace. The furnace temperature is then raised to 400° C. for 2 hours. The temperature is then set at 600° C. with dry air purging for 16 hours. At this time the catalyst is cooled down under $N_2$ to a temperature of 300° C. Then a stream of pure CO (99.99% from Matheson) is introduced for one hour. Finally, the catalyst is cooled down to room temperature under $N_2$ and ready for use.

EXAMPLE 9

The catalyst prepared in Example 8 (3.2 g is packed in a ⅜" stainless steel tubular reactor inside an $N_2$ blanketed dry box. The reactor under $N_2$ atmosphere is then heated to 150° C. by a single-zone Lindberg furnace. Prepurified 1-hexene is pumped into the reactor at 140 psi and 20 cc/hr. The liquid effluent is collected and stripped of the unreacted starting material and the low boiling material at 0.05 mm Hg. The residual clear, colorless liquid has viscosities and VI's suitable as a lubricant base stock.

| Sample | Prerun | 1 | 2 | 3 |
|---|---|---|---|---|
| *T.O.S., hr. | 2 | 3.5 | 5.5 | 21.5 |
| Lube Yield, wt % | 10 | 41 | 74 | 31 |
| Viscosity, cs, at | | | | |
| 40° C. | 208.5 | 123.3 | 104.4 | 166.2 |
| 100° C. | 26.1 | 17.1 | 14.5 | 20.4 |
| VI | 159 | 151 | 142 | 143 |

*time on stream

EXAMPLE 10

Similar to Example 9, a fresh catalyst sample is charged into the reactor and 1-hexene is pumped to the reactor at 1 atm and 10 cc per hour. As shown below, a lube of high viscosities and high VI's is obtained. These runs show that at different reaction conditions, a lube product of high viscosities can be obtained.

| Sample | A | B |
|---|---|---|
| T.O.S., hrs. | 20 | 44 |
| Temp., °C. | 100 | 50 |
| Lube Yield, % | 8.2 | 8.0 |
| Viscosities, cs at | | |
| 40° C. | 13170 | 19011 |
| 100° C. | 620 | 1048 |
| VI | 217 | 263 |

EXAMPLE 11

A commercial chrome/silica catalyst which contains 1% Cr on a large-pore volume synthetic silica gel is used. The catalyst is first calcined with air at 800° C. for 16 hours and reduced with CO at 300° C. for 1.5 hours. Then 3.5 g of the catalyst is packed into a tubular reactor and heated to 100° C. under the $N_2$ atmosphere. 1-Hexene is pumped through at 28 cc per hour at 1 atmosphere. The products are collected and analyzed as follows:

| Sample | C | D | E | F |
|---|---|---|---|---|
| T.O.S., hrs. | 3.5 | 4.5 | 6.5 | 22.5 |
| Lube Yield, % | 73 | 64 | 59 | 21 |
| Viscosity, cS, at | | | | |
| 40° C. | 2548 | 2429 | 3315 | 9031 |
| 100° C. | 102 | 151 | 197 | 437 |
| VI | 108 | 164 | 174 | 199 |

These runs show that different Cr on a silica catalyst are also effective for oligomerizing olefins to lube products.

EXAMPLE 12

As in Example 11, purified 1-decene is pumped through the reactor at 250 to 320 psi. The product is collected periodically and stripped of light products boiling points below 650° F. High quality lubes with high VI are obtained (see following table).

| Reaction Temp. °C. | WHSV g/g/hr | Lube Product Properties V at 40° C. | V at 100° C. | VI |
|---|---|---|---|---|
| 120 | 2.5 | 1555.4 cs | 157.6 cs | 217 |
| 135 | 0.6 | 389.4 | 53.0 | 202 |
| 150 | 1.2 | 266.8 | 36.2 | 185 |
| 166 | 0.6 | 67.7 | 12.3 | 181 |
| 197 | 0.5 | 21.6 | 5.1 | 172 |

EXAMPLE 13

Similar catalyst is used in testing 1-hexene oligomerization at different temperature. 1-Hexene is fed at 28 cc/hr and at 1 atmosphere.

| Sample | G | H |
|---|---|---|
| Temperature, °C. | 110 | 200 |
| Lube Yield, wt. % | 46 | 3 |
| Viscosities, cS at | | |
| 40° C. | 3512 | 3760 |
| 100° C. | 206 | 47 |
| VI | 174 | 185 |

EXAMPLE 14

1.5 grams of a similar catalyst as prepared in Example 11 is added to a two-neck flask under $N_2$ atmosphere. Then 25 g of 1-hexene is added. The slurry is heated to 55° C. under $N_2$ atmosphere for 2 hours. Then some heptane solvent is added and the catalyst is removed by filtration. The solvent and unreacted starting material are stripped off to give a viscous liquid with a 61% yield. This viscous liquid has viscosities of 1536 and 51821 cs at 100° C. and 40° C., respectively. This example demonstrated that the reaction can be carried out in a batch operation.

The 1-decene oligomers as described below are synthesized by reacting purified 1-decene with an activated chromium on silica catalyst The activated catalyst is prepared by calcining chromium acetate (1 or 3% Cr) on silica gel at 500°-800° C. for 16 hours, followed by treating the catalyst with CO at 300°-350° C. for 1 hour. 1-Decene is mixed with the activated catalyst and heated to reaction temperature for 16-21 hours. The catalyst is then removed and the viscous product is distilled to remove low boiling components at 200° C./0.1 mmHg.

Reaction conditions and results for the lube synthesis of HVI-PAO are summarized below:

| Example NO. | Cr on Silica | Calcination Temp. | Treatment Temp. | 1-decene/ Catalyst Ratio | Lube Yld |
|---|---|---|---|---|---|
| 15 | 3 wt % | 700° C. | 350° C. | 40 | 90 |
| 16 | 3 | 700 | 350 | 40 | 90 |
| 17 | 1 | 500 | 350 | 45 | 86 |
| 18 | 1 | 600 | 350 | 16 | 92 |

Branch Ratios and Lube Properties of Examples 15-18 Alpha Olefin Oligomers

| Example No. | Branch Ratios $\frac{CH_3}{CH_2}$ | $V_{40}$ °C. | $V_{100}$ °C. | VI |
|---|---|---|---|---|
| 15 | 0.14 | 150.5 | 22.8 | 181 |
| 16 | 0.15 | 301.4 | 40.1 | 186 |
| 17 | 0.16 | 1205.9 | 128.3 | 212 |
| 18 | 0.15 | 5238.0 | 483.1 | 271 |

Branch Ratios and Lubricating Properties of Alpha Olefin Oligomers Prepared in the Prior-Art

| Example No. | Branch Ratios $\frac{CH_3}{CH_2}$ | $V_{40}$ °C. | $V_{100}$ °C. | VI |
|---|---|---|---|---|
| 19 | 0.24 | 28.9 | 5.21 | 136 |
| 20 | 0.19 | 424.6 | 41.5 | 148 |
| 21 | 0.19 | 1250 | 100 | 168 |
| 22 | 0.19 | 1247.4 | 98.8 | 166 |

These samples are obtained from the commercial market. They have higher branch ratios than samples in Table 2. Also, they have lower VI's than the previous samples.

Comparison of these two sets of lubricants clearly demonstrates that oligomers of alpha-olefins, as 1-decene, with branch ratios lower than 0.19, preferably from 0.13 to 0.18, have higher VI and are better lubricants. The examples prepared in accordance with this invention have branch ratios of 0.14 to 0.16, providing lube oils of excellent quality which have a wide range of viscosities from 3 to 483.1 cs at 100° C. with viscosity indices of 130 to 280.

EXAMPLE 23

A commercial Cr on silica catalyst which contains 1% Cr on a large pore volume synthetic silica gel is used. The catalyst is first calcined with air at 700° C. for 16 hours and reduced with CO at 350° C. for one to two hours. 1.0 part by weight of the activated catalyst is added to 1-decene of 200 parts by weight in a suitable reactor and heated to 185° C. 1-Decene is continuously fed to the reactor at 2-3.5 parts/minute and 0.5 parts by weight of catalyst is added for every 100 parts of 1-decene feed. After 1200 parts of 1-decene and 6 parts of catalyst are charged, the slurry is stirred for 8 hours. The catalyst is filtered and light product boiled below 150° C. @ 0.1 mm Hg is stripped. The residual product is hydrogenated with a Ni on Kieselguhr catalyst at 200° C. The finished product has a viscosity at 100° C. of 18.5 cs, VI of 165 and pour point of −55° C.

EXAMPLE 24

Similar as in Example 23, except reaction temperature is 185° C. The finished product has a viscosity at 100° C. of 145 cs, VI of 214, pour point of −40° C.

EXAMPLE 25

Similar as in Example 23, except reaction temperature is 100° C. The finished product has a viscosity at 100° C. of 298 cs, VI of 246 and pour point of −32° C.

The final lube products in Example 23 to 25 contain the following amounts of dimer and trimer and isomeric distribution (distr.).

| Example | 23 | 24 | 25 |
|---|---|---|---|
| Vcs @ 100° C. | 18.5 | 145 | 298 |
| VI | 165 | 214 | 246 |
| Pour Point, °C. | −55° C. | −40° C. | −32 |
| wt % dimer | 0.01 | 0.01 | 0.027 |
| | wt % isomeric distr. dimer | | |
| n-eicosane | 51% | 28% | 73% |
| 9-methylnonacosane | 49% | 72% | 27% |
| wt % trimer | 5.53 | 0.79 | 0.27 |
| | wt % isomeric distr. trimer | | |
| 11-octyldocosane | 55 | 48 | 44 |
| 9-methyl,11-octyl-heneicosane | 35 | 49 | 40 |
| others | 10 | 13 | 16 |

These three examples demonstrate that the new HVI-PAO of wide viscosities contain the dimer and trimer of unique structures in various proportions.

The molecular weights and molecular weight distributions are analyzed by a high pressure liquid chromatography, composed of a Constametric II high pressure, dual piston pump from Milton Roy Co. and a Tracor 945 LC detector. During analysis, the system pressure is 650 psi and THF solvent (HPLC grade) deliver rate is 1 cc per minute. The detector block temperature is set at 145° C. cc of sample, prepared by dissolving 1 gram PAO sample in cc THF solvent, is injected into the chromatograph. The sample is eluted over the following columns in series, all from Waters Associates: Utrastyragel $10^5$ A, P/N 10574, Utrastyragel $10^4$ A, P/N 10573, Utrastyragel $10^3$ A, P/N 10572, Utrastyragel 500 A, P/N 10571. The molecular weights are calibrated against commercially available PAO from Mobil Chemical Co, Mobil SHF-61 and SHF-81 and SHF-401.

The following table summarizes the molecular weights and distributions of Examples 16 to 18.

| Examples | 23 | 24 | 25 |
|---|---|---|---|
| V @ 100° C., cs | 18.5 | 145 | 298 |
| VI | 165 | 214 | 246 |
| number-averaged molecular weights, $MW_n$ | 1670 | 2062 | 5990 |
| weight-averaged molecular weights, $MW_w$ | 2420 | 4411 | 13290 |
| molecular weight distribution, MWD | 1.45 | 2.14 | 2.22 |

The following examples describe a prefered method of preparation of HVI-PAO as employed to prepare the products of the instant invention.

EXAMPLE 19

A HVI-PAO having a nominal viscosity of 20 cs at 100° C. is prepared by the following procedure: 100 weights of 1-decene purified by nitrogen sparging and passing over a 4A molecular sieve is charged to a dry nitrogen blanketed reactor. The decene is then heated to 185° C. and 3.0 weights of a prereduced 1% Chromium on silica catalyst added together with an additional 500 weights of purified 1-decene continuously over a period of 7.0 hr with the reaction temperature maintained at 185° C. The reactants are held for an additional 5.0 hr at 185° C. after completion of the 1-decene and catalyst addition to comple the reaction. The product is then filtered to remove the catalyst and stripped to 270° C. and 2 mm Hg pressure to remove unreacted 1-decene and unwanted low molecular weight oligomers.

EXAMPLE 20

A HVI-PAO having a nominal viscosity of 149 cs at 100° C. is prepared by a procedure similar to that in Example 19 except that the 1-decene/catalyst addition time is 9.0 hr, the hold time after 1-decene/catalyst addition is 2.0 hr, and the reaction temperature is 123° C.

Under similar conditions, HVI-PAO product with viscosity as low as 3cs and as high as 500 cs, with VI between 130 and 280, can be produced.

The use of supported Group VIB oxides as a catalyst to oligomerize olefins to produce low branch ratio lube products with low pour points was heretofore unknown. The catalytic production of oligomers with structures having a low branch ratio which does not use a corrosive co-catalyst and produces a lube with a wide range of viscosities and good V.I.'s was also heretofore unknown and more specifically the preparation of lube oils having a branch ratio of less than about 0.19 was also unknown heretofore.

The novel phosphite functionalized lubricants of the present invention may be incorporated as blends with other lubricants and polymer systems in quantities ranging from 0.1 to 100% or may, themselves, be used as additives or in substitution for conventional additives. Lubricants and polymer systems which can be blended with the phosphite functionalized lubricants include: mineral oil derived from petroleum; hydrogenated polyolefins comprise polybutylene,polypropylene and polyalpha-olefins with a branch ratio greater than 0.19; polyethers comprising polyethylene gylcol; vinyl polymers comprising polymethylmethacrylate and polyvinylcholoride; polyflurocarbons comprising polyfluoroethylene; polychloroflurocarbons comprising polychlorofluroethylene; polyesters comprising polyethyleneterephthate and polyethyleneadipate; polycarbonates comprising polybisphenol-A carbonate, polyurethanes comprising polyethylenesuccinoylcarbamate; polyacetals comprising polyoxymethylene; and polyamides comprising polycaprolactam.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. A composition comprising a lubricant range hydrocarbon adduct containing phosphonate function groups, said adduct obtained by the steps comprising reacting olefinic $C_{20}$+ polyalpha-olefin produced by the oligomerization of a $C_8$–$C_{20}$ olefin in the presence of a reduced Group VIB metal oxide catalyst and having a number average molecular weight of about 300 to 18,000, a viscosity index greater than 130 and a pour point below −15° C., a molecular weight distribution between 1 and 5 and a branch ratio of less than 0.19 with phosphite ester in a mixture with peroxide catalyst at elevated temperature; and separating said reaction mixture products and recovering said adduct.

2. The composition of claim 1 wherein said polyalpha-olefin comprises the unsaturated polymeric or copolymeric residue of $C_8C_{20}$ 1-alkene oligomerized in contact with carbon monoxide reduced chromium on silica catalyst.

3. The composition of claim 2 wherein said polyalpha-olefin oligomer has a a viscosity index above 130 and molecular weight between 400 and 14,000 and pour point below −25° F.

4. The composition of claim 1 wherein said phosphite ester is selected from the group consisting of (I)

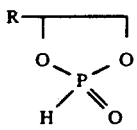

(II)

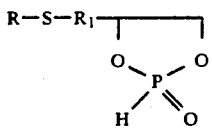

(III)

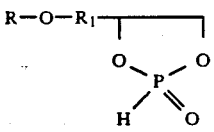

(IV)

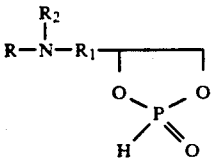

(V)

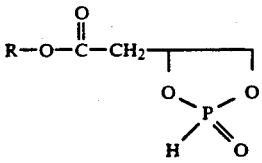

(VI)

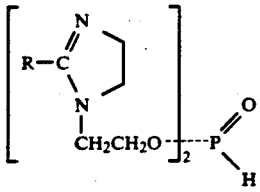

(VII)

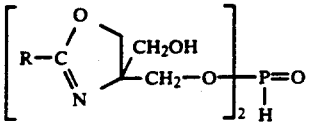

-continued (VIII)

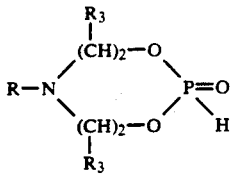

(IX)

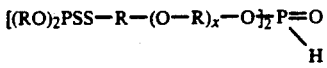

(X)

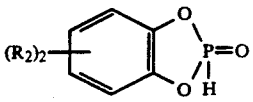

(XI)

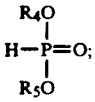

including open chain derivatives of I-V, VIII and X and cyclic derivatives of VII, where R in I-X is a carbon radical of an aliphatic or aromatic moiety, substituted or unsubstituted, linear, cyclic or heterocyclic wherein substitutent moieties comprise hydrocarbyl or hydrocarbyl containing oxygen, nitrogen, sulfur or halogen and x in (IX) is 0–10 and; where $R_1$ is selected from $C_1$–$C_{20}$ aliphatic or aromatic hydrocarbon diyl and; where $R_2$ is hydrogen, alkyl, alkenyl, aryl or aralkyl and; $R_3$ is hydrogen or $C_1$–$C_8$ alkyl or alkenyl and;

where $R_4$ and $R_5$ in (XI) are alkyl of 1 to 18 carbon atoms, cycloalkyl of 2 to 12 carbon atoms, phenyl, alkylated phenyl, aralkyl, alkylated aralkyl or where $R_4$ and $R_5$ are each said alkyl, cycloalkyl, phenyl, aralkyl or alkylated aralkyl moieties containing oxo, amino or thio groups.

5. The composition of claim 1 wherein said adduct comprises the reaction product of dibutyl phosphite and olefinic polyalpha-olefin having a viscosity of 20cSt, said adduct having extreme pressure wear resistent properties.

6. A lubricant composition comprising a mixture of phosphonate isomers having the structural formula

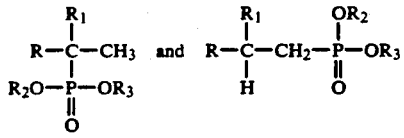

where R and $R_1$ in combination are $C_{28}$+ hydrocarbyl having a branch ratio less than 0.19, $R_2$ and $R_3$ are each aliphatic or aromatic substituted or unsubstituted linear, cyclic or heterocyclic hydrocarbon groups; wherein substituent moieties comprise hydrocarbyl or hydrocarbyl containing oxygen, nitrogen, sulfur or halogen, the isomers being obtained by reacting olefinic $C_{20}$ + polyalpha-olefin oligomer produced by the oligomerization of $C_8$–$C_{20}$ olefin in the presence of a reduced Group VIB metal oxide catalyst the oligomer having a number average molecular weight of about 300 to 18,000, a viscosity index greater than 130 and a pour point below −15° C., a molecular weight distribution between 1 and 5 and a branch ratio of less than 0.19 phosphite ester.

7. A lubricant composition having enhanced viscosity index comprising from 0.1 to 100 weight percent of a phosphite-functionalized derivative of polyalpha-olefin having a branch ratio of less than 0.19; said polyalpha-olefin having a number average molecular weight of about 300 to 18,000, viscosity index greater than 130 and pour point below 15° C.

8. The lubricant composition of claim 7 wherein said polyalpha-olefin comprises the unsaturated polymeric or copolymeric residue of 1-alkenes consisting essentially of $C_8C_{20}$ 1-alkenes.

9. The lubricant of claim 7 wherein said polyalpha-olefin comprises of poly-1-decene.

10. The lubricant composition of claim 7 including a mixture of said phosphite-functionalized derivative of polyalpa-olefin and at least one lubricant range hydrocarbon selected from mineral oil comprising $C_{30}$+ hydrocarbons; hydrogenated polyolefins comprising polybutylene,polypropylene and polyalpha-olefins with a branch ratio greater than 0.19; polyethers comprising polyethylene glycol, vinyl polymers comprising polymethylmethacrylate and polyvinylcholoride; polyflurocarbons comprising polytetrafluoroethylene; polychloroflurocarbons comprising polychlorofluroethylene; polyesters comprising polyethyleneterephthate and polyethyleneadipate; polycarbonates comprising polybisphenol-A carbonate, polyurethanes comprising polyethylenesuccinoylcarbamate; polyacetals comprising polyoxymethylene; and polyamides comprising polycaprolactam.

11. A lubricant mixture according to claim 10 wherein said mixture comprises between 1 and 99 weight percent of said polyalpha-olefin with a kinematic viscosity at 100 degrees C. of about 1 to 200 cs.

12. The lubricant mixture of claim 10 wherein said polyalpha-olefin has a kinematic viscosity of between 4–20 cs and comprises at least about 20 weight percent of said mixture.

13. The lubricant range hydrocarbon adduct of claim 1 further comprising lubricant additives selected from the group consisting of dispersants, detergents, viscosity index improvers, extreme pressure/antiwear additives, antioxidants, pour depressants, emulsifiers, demulsifiers, corrosion inhibitors, antirust inhibitors, antistaining additives, and friction modifiers.

14. A method for decreasing wear and reducing friction in an internal combustion engine by lubricating said engine with a friction reducing amount of a product of reaction made by a process for the preparation of lubricant range hydrocarbons containing phosphonate functional groups comprising;

reacting olefinic $C_{30}$+ polyalpha-olefin oligomers produced by the oligomerization of a $C_8$–$C_{20}$ olefin in the presence of a reduced Group VIB metal oxide catalyst and having a number average molecular weight from about 300 to 18,000, a molecular weight distribution from 1 and 5, a viscosity index greater than 130, a branch ratio of less than 0.19 and a pour point below −15° C., with phosphite ester in a mixture with free radical generating catalyst at elevated temperature wherein phosphite ester adduct of said polyalpha-olefin is formed;

separating said reaction mixture products and recovering said adduct.

15. The method of claim 14 wherein said $C_{30}$ + polyalpha-olefin oligomer has a viscosity index above 130, number average molecular weight between 300 and 1800, molecular weight distribution between 1 and 5 and pour point below −15° C.

16. The method of claim 15 wherein said phosphite ester comprises dibutyl hydrogen phosphite.

* * * * *